US005924949A

United States Patent [19]

Fan

[11] Patent Number: 5,924,949

[45] Date of Patent: Jul. 20, 1999

[54] APPARATUS FOR DRIVING A ROLLER-SHUTTER DOOR

[75] Inventor: Kenneth S. Fan, Chungho, Taiwan

[73] Assignee: Chain-Tech International Corporation, Taipei Hsien, Taiwan

[21] Appl. No.: 08/985,812

[22] Filed: Dec. 5, 1997

[51] Int. Cl.[6] ..... E06B 9/56

[52] U.S. Cl. ..... 475/149; 200/33 B; 200/47; 49/28; 160/310; 192/142 R

[58] Field of Search ..... 200/19 R, 33 R, 200/38 R, 33 B, 47, 501; 49/28, 31; 160/310, 311; 475/149, 153; 192/142 R

[56] References Cited

U.S. PATENT DOCUMENTS

| | | | |
|---|---|---|---|
| 3,512,302 | 5/1970 | Sivin et al. | 160/310 X |
| 4,172,563 | 10/1979 | Werner et al. | 160/310 X |
| 4,342,354 | 8/1982 | Leivenzon et al. | 49/28 X |
| 4,392,392 | 7/1983 | Perisic et al. | 160/310 X |
| 4,644,813 | 2/1987 | Whitehouse et al. | 160/310 X |
| 5,447,477 | 9/1995 | Bresson et al. | 160/310 X |

*Primary Examiner*—Charles A. Marmor
*Assistant Examiner*—Ankur Parekh
*Attorney, Agent, or Firm*—Kolisch Hartwell Dickinson McCormack & Heuser

[57] ABSTRACT

Apparatus for driving a roller-shutter door comprises a driving plate, a planetary-gearset, a stationary housing, and adjustable control means. The adjustable control means is mounted in the stationary housing for cooperating with the driving plate as well as the planetary-gearset for controlling the actuation of a motor whereby a roller-shutter door can be moved to a predetermined limit position. More especially, the adjustable control means is disposed to extend from the stationary housing such that the adjustable control means can be manually adjusted from outside of the stationary housing.

5 Claims, 4 Drawing Sheets

APPARATUS FOR DRIVING A ROLLER-SHUTTER DOOR

BACKGROUND OF THE INVENTION

The present invention relates to an apparatus for driving a roller-shutter door, and more particularly to a driving apparatus by which the control means thereof can be easily adjusted from outside of the apparatus without dis-assembling the apparatus to be adaptable for doors of different heights.

It is found that when a conventional apparatus for driving a roller-shutter door is employed in a door of a height different from a standard height, the apparatus has to be dis-assembled before adjusting the control means of the apparatus by which the roller-shutter door can be moved to another limit position (including the upper limit position and the lower limit position) to be adaptable for the door of different height. Generally, the control means of conventional apparatus is encased by the apparatus housing. Thus, when an adjustment is required, the apparatus housing has to be dis-assembled first. However, the dis-assembling process is troublesome and time-consuming.

In view of the foregoing, the applicant has invented an apparatus by which the control means thereof can be adjusted from outside of the apparatus without a need for dis-assembling the apparatus.

BRIEF SUMMARY OF THE INVENTION

The primary object of the present invention is to provide an apparatus for driving a roller-shutter door, by which the control means thereof can be adjusted from outside of the apparatus without dis-assembling the apparatus.

In accordance with one aspect of the present invention, an embodiment comprises a driving plate, a planetary-gearset, a stationary housing, and an adjustable control means. The driving plate has a central hub which has a geared portion provided on the outside surface thereof. The planetary-gearset includes a sun gear, a plurality of planet pinions and a ring gear. The sun gear has a geared hub which is coaxially mounted about the central hub of the driving plate. The plurality of planet pinions are mounted on the driving plate at a predetermined distance from the central hub of the driving plate to mesh with the sun gear. The ring gear has a round opening defined at the center thereof. The ring gear is disposed to mesh with the plurality of planet pinions. The stationary housing has a conjugated round opening which is defined corresponding to the round opening of the ring gear. The stationary housing is adapted to be coaxially joined with the ring gear to be rotated integrally therewith. The central hub of the driving plate together with the geared hub of the sun gear is placed into the round opening of the ring gear and the conjugated round opening of the stationary housing to allow the geared hub of the sun gear and the geared portion of the central hub of the driving plate to enter the stationary housing. The geared hub of the sun gear is drivable by a motor such that the sun gear can be rotated. The adjustable control means is disposed in the stationary housing and meshes with the geared portion of the central hub of the driving plate for controlling the actuation of the motor whereby the roller-shutter door can be moved to a predetermined limit position. The adjustable control means is disposed to extend from the stationary housing to be manually adjusted from outside of the stationary housing.

Other advantages and novel aspects of the invention will become more apparent from the following detailed description when taken in conjunction with the accompanying drawings.

DETAIL DESCRIPTION OF THE PREFERRED EMBODIMENT

Figure 1:
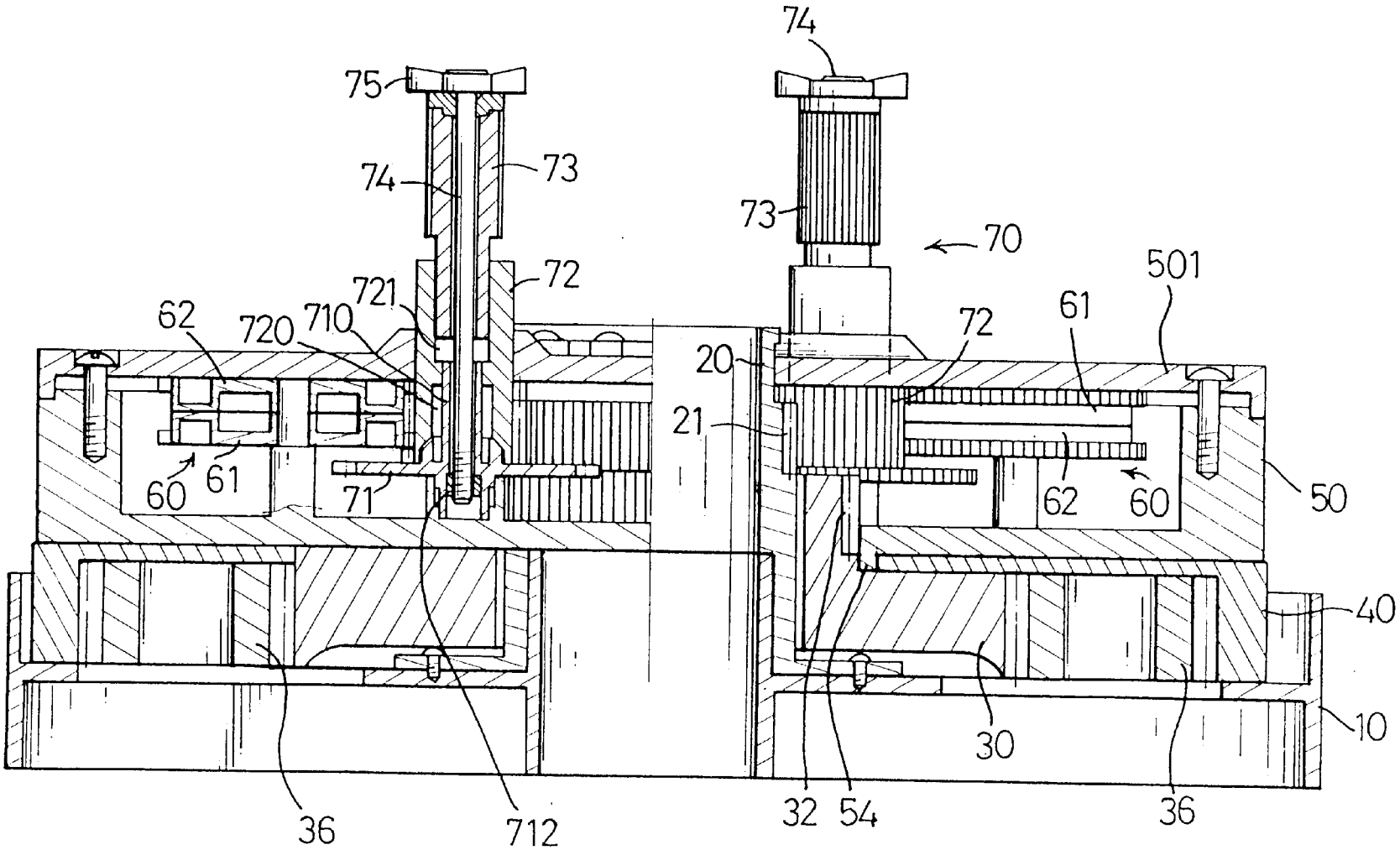
FIG. 1 is a partially sectional view of an embodiment of the present invention.

Referring to FIG. 1, a typical embodiment of an apparatus for driving a roller-shutter door in accordance with the present invention comprises a driving plate 10, a planetary-gearset (not labelled), a stationary housing 50, and an adjustable control means (not labelled). The stationary housing 50 includes a cover 501. The driving plate 10 has a central hub 20 attached therewith. In practice, the driving plate 10 is provided with a driving wheel over which a roller-shutter door (not shown) can be carried. The central hub 20 has a geared portion 21 provided on the outside surface thereof. The planetary-gearset includes a sun gear 30, a plurality of planet pinions 36 and a ring gear 40. The sun gear 30 has a geared hub 32 which is coaxially mounted about the central hub 20 of the driving plate 10. The plurality of planet pinions 36 are mounted on the driving plate 10 at a predetermined distance from the central hub 20 of the driving plate 10 to mesh with the sun gear 30. The ring gear 40 has a round opening (not labelled) defined at the center thereof. As shown in FIG. 1, the ring gear 40 is disposed to mesh with the plurality of planet pinions 36. The stationary housing 50 has a conjugated round opening (not labelled) which is defined corresponding to the round opening of the ring gear 40. The stationary housing 50 has a connecting neck 54 provided around the conjugated round opening of the stationary housing 50. The connecting neck 54 can be snappingly received in the round opening of the ring gear 40, thereby allowing the stationary housing 50 to be coaxially joined with the ring gear 40 so that the stationary housing 50 can be rotated integrally with the ring gear 40. The central hub 20 of the driving plate 10 together with the geared hub 32 of the sun gear 30 is placed into the round opening of the ring gear 40 and the conjugated round opening of the stationary housing 50 to allow the geared hub 32 of the sun gear 30 and the geared portion 21 of the central hub 20 of the driving plate 10 to enter into the stationary housing 50. The sun gear 30 can be rotated by a motor through the geared hub 32. In such an arrangement, when the sun gear 30 is driven to rotate by the motor, the driving plate 10 can be rotated through the planet pinions 36 and the ring gear 40 such that a roller-shutter door can be moved upwardly to open a door or downwardly.

Figure 2:
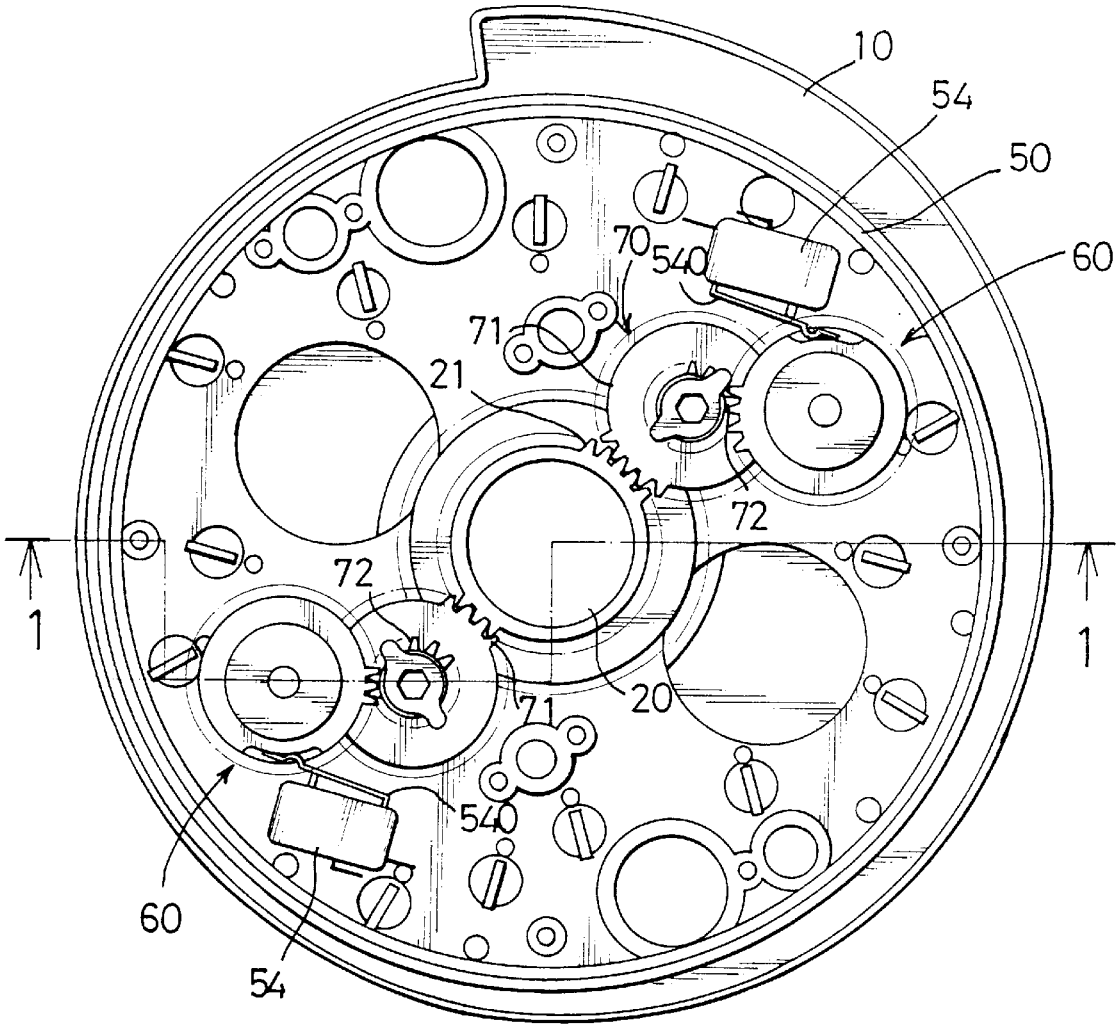
FIG. 2 is a plan view of the embodiment.
Figure 3:
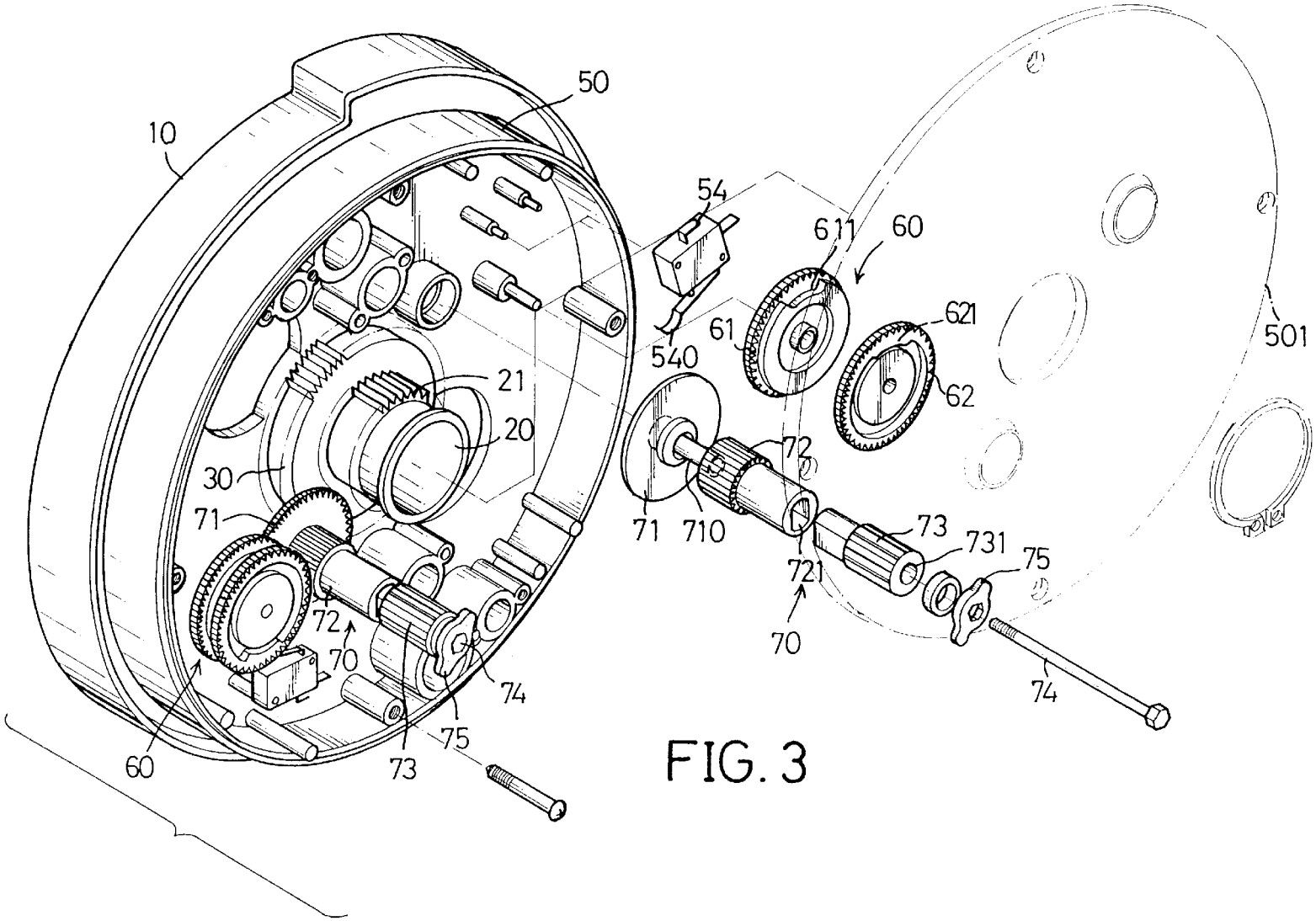
FIG. 3 is a partially exploded view of the embodiment.

As shown in FIG. 1, FIG. 2 and FIG. 3, two adjustable control means, each of which includes a timing gearset 60, an adjusting gearset 70 and a micro-switch 54, are mounted in the stationary housing 50. The timing gearset 60 includes a first timing gear 61 and a second timing gear 62. The first timing gear 61 has a first recessed surface 611 defined thereon. The second timing gear 62 has a second recessed surface 621 defined thereon. The first timing gear 61 and the second timing gear 62 have a same pitch number (diametral pitch) and a same pitch diameter but have different tooth numbers. The first timing gear 61 and the second timing gear 62 are coaxially mounted in the stationary housing 50. The first recessed surface 611 of the first timing gear 61 is arranged to face the second recessed surface 621 of the second timing gear 62 and the two recessed surfaces 611, 621 are offset by a predetermined angle in the beginning.

Since the tooth number of the first timing gear 61 is different from the tooth number of the second timing gear 62, the first recessed surface 611 of the first timing gear 61 and the second recessed surface 621 of the second timing gear 62 can coincide with each other when the first timing gear 61 and the second timing gear 62 are rotated an angle, which depends on the difference of the tooth number between the first timing gear 61 and the second timing gear 62. The adjusting gearset 70 includes a first adjusting gear 71, a second adjusting gear 72, an adjusting knob 73, and a connecting rod 74. The first adjusting gear 71 is mounted in the stationary housing 50 to mesh with the geared portion 21 of the central hub 20 of the driving plate 10. The second adjusting gear 72 is coaxially mounted with the first adjusting gear 71. The second adjusting gear 72 is disposed to mesh with the first timing gear 61 and the second timing gear 62.

Figure 4:
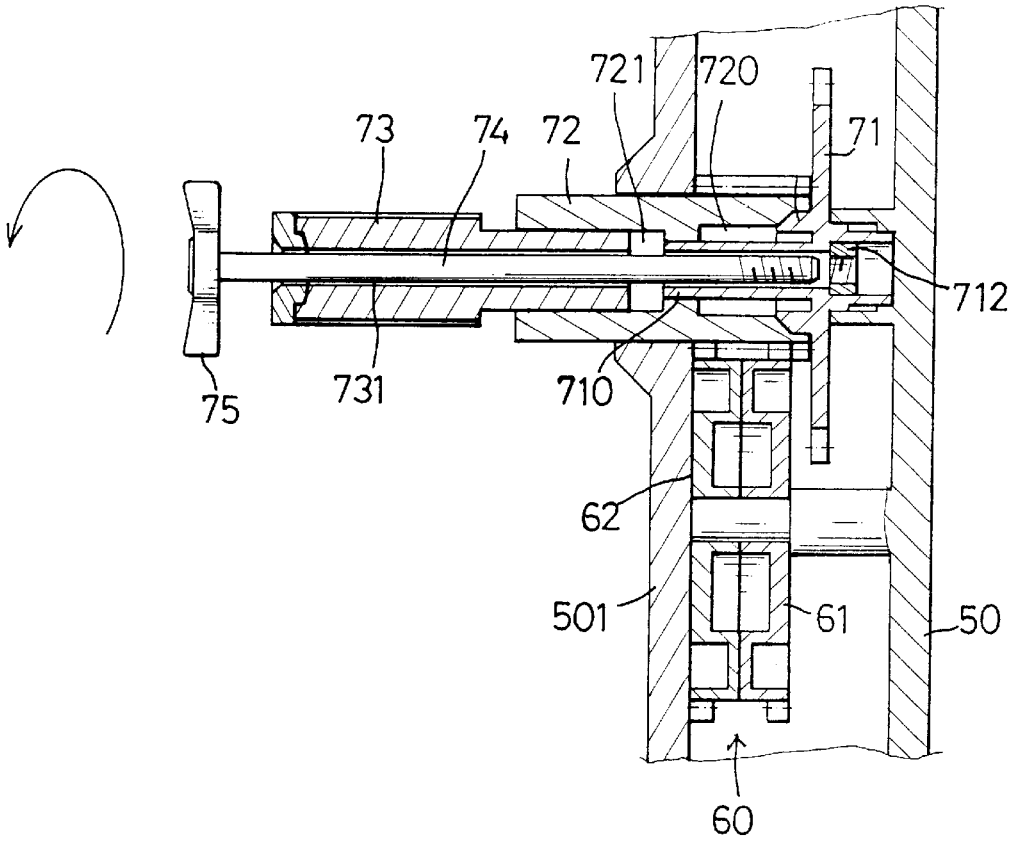
FIG. 4 is a fragmentary sectional view of the embodiment.

As shown in FIG. 3, the first adjusting gear 71 has a hub 710 formed at the center thereof. The first adjusting gear 71 is provided with a nut 712 (see FIG. 1 and FIG. 4) in the hub 710. The second adjusting gear 72 is formed as a geared axle in which a circular cross-sectional recess 720 (see FIG. 1) and a non-circular cross-sectional recess 721 is defined. The circular cross-sectional recess 720 is communicated with the non-circular cross-sectional recess 721. The circular cross-sectional recess 720 is capable of receiving the hub 710 of the first adjusting gear 71. The non-circular cross-sectional recess 721 is capable of receiving the adjusting knob 73 which has a through hole 731 defined therein. It is to be noted that the adjusting knob 73 and part of the second adjusting gear 72 are disposed outside of the stationary housing 50 to conduct an adjustment without dis-assembling the stationary housing 50. The connecting rod 74 can be inserted in the through hole 731 of the adjusting knob 73 and the central hub 710 of the first adjusting gear 71 to be threadedly engaged with the nut 712 provided in the hub 710 to have the second adjusting gear 72 frictionally engaged with the first adjusting gear 71, so that the second adjusting gear 72 can be integrally rotated with the first adjusting gear 71. In such an arrangement, when the sun gear 30 is driven to rotate by a motor, the first timing gear 61 and the second timing gear can be rotated via the adjusting gearset 70.

As can be seen in FIG. 3, the connecting rod 74 is preferably provided with a wing-like head 75 for facilitating manual adjustment. By means of the wing-like head 75, the engagement or disengagement between the first adjusting gear 71 and the second adjusting gear 72 can be easily rendered.

As shown in FIGS. 2 and 3, each micro-switch 54 has a actuating lever 540 which is placed in contact with a corresponding timing gearset 60 which includes the first timing gear 61 and the second timing gear 62. In such an arrangement, when the motor drives the sun gear 30 in one direction to rotate the driving plate 10 to raise the roller-shutter door, the actuating lever 54 of one micro-switch 54 (first) can extend into the recess which is formed by the coincidence of the first recessed surface 611 and the second recessed surface 621, so that the first micro-switch 54 can be de-actuated to stop the motor. At this time, the roller-shutter door is moved to an upper predetermined limit position. When the motor drives the sun gear in an opposite direction to rotate the driving plate 10 to lower the roller-shutter door, the actuating lever 540 of the other micro-switch 54 (second) can extend into the recess which is formed by the coincidence of the first recessed surface 611 and the second recessed surface 621, so that the second micro-switch 54 can be de-actuated to stop the motor. At this time, the roller-shutter door is moved to a lower predetermined limit position. When the aforementioned "upper predetermined limit position" or the aforementioned "lower predetermined limit position" need to be changed to be adaptable for a roller-shutter door of a different height, a corresponding connecting rod 74 can be threadedly unfastened from a corresponding nut 712 to allow a corresponding second adjusting gear 72 to disengage from a corresponding first adjusting gear 71. Therefore, the corresponding second adjusting gear 72 can be turned relative to the corresponding first adjusting gear 71 to change the position of the recessed surface 611 of the first timing gear 61 relative to the recessed surface 621 of the second timing gear 62 (see FIG. 4), thereby controlling the time at which the motor can be stopped to allow a roller-shutter door to be moved to another limit position.

In view of the foregoing, it is to be noted that the adjusting knob 73 of the adjusting gearset 70 is disposed to extend from the stationary housing 50. Thus, the timing gearset 60 can be manually adjusted without removing the cover 501. This may save a lot of time to enable the present invention adaptable for a door of different height.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. Apparatus for driving a roller-shutter door, comprising:

a driving plate having a central hub which has a geared portion provided on the outside surface thereof;

a planetary-gearset including a sun gear, a plurality of planet pinions and a ring gear, said sun gear having a geared hub which is coaxially mounted about said central hub of said driving plate, said plurality of planet pinions being mounted on said driving plate at a predetermined distance from said central hub of said driving plate to mesh with said sun gear, said ring gear having a round opening defined at the center thereof, said ring gear being disposed to mesh with said plurality of planet pinions;

a stationary housing having a conjugated round opening which is defined corresponding to said round opening of said ring gear, said stationary housing adapted to be coaxially joined with said ring gear to be rotated integrally therewith, said central hub of said driving plate together with said geared hub of said sun gear being placed into said round opening of said ring gear and said conjugated round opening of said stationary housing to allow said geared hub of said sun gear and said geared portion of said central hub of said driving plate to enter into said stationary housing, said geared hub of said sun gear drivable by a motor to rotate said sun gear; and adjustable control means disposed in said stationary housing and meshing with said geared portion of said central hub of said driving plate for controlling the actuation of said motor whereby a roller-shutter door can be moved to a predetermined limit position, said adjustable control means being disposed to extend from said stationary housing to be manually adjusted from outside of said stationary housing.

2. Apparatus as claimed in claim 1, wherein said adjustable control means comprises a timing gearset, an adjusting gearset and a micro-switch, said micro-switch being disposed in electrical communication with said motor and in cooperation with said timing gearset, said adjusting gearset being meshed with said geared portion of said central hub of said driving plate and being meshed with said timing gearset, said timing gearset being rotatably adjustable by said adjusting gearset to allow said motor to be stopped at a predetermined time so that a roller-shutter door can be moved to a predetermined limit position.

3. Apparatus as claimed in claim 2, wherein said timing gearset including a first timing gear and a second timing gear, said first timing gear having a first recessed surface defined thereon, said second timing gear having a second recessed surface defined thereon, said first timing gear and said second timing gear having a same pitch number and a same pitch diameter but having different tooth numbers, said first timing gear and said second timing gear being coaxially mounted in said stationary housing, said first recessed surface of said first timing gear being arranged to face said second recessed surface of said second timing gear, said adjusting gearset including a first adjusting gear and a second adjusting gear, said first adjusting gear being mounted in said stationary housing to mesh with said geared portion of said central hub of said driving plate, said second adjusting gear being coaxially mounted with said first adjusting gear and being meshed with said first timing gear and said second timing gear so that said second adjusting gear can be integrally rotated with said first adjusting gear to rotate said first timing gear and said second timing gear, said micro-switch having an actuating lever which is placed in contact with said first timing gear and said second timing gear, whereby when said sun gear is rotated a predetermined amount by said motor, said first recessed surface of said first timing gear and said second recessed surface of said second timing gear may coincide with each other, so that said micro-switch may extend into the recess which is formed by the coincidence of said first recessed surface and said second recessed surface, so that said micro-switch can be de-actuated to stop the roller-shutter door at a a predetermined limit position.

4. Apparatus as claimed in claim 3, wherein said first adjusting gear has a hub formed at the center thereof, said first adjusting gear being provided with a nut in said hub of said first adjusting gear, said second adjusting gear being formed as a geared axle in which a circular cross-sectional recess and a non-circular cross-sectional recess is defined, said circular cross-sectional recess being communicated with said non-circular cross-sectional recess, said circular cross-sectional recess capable of receiving said hub of said first adjusting gear, said non-circular cross-sectional recess capable of receiving an adjusting knob which has a through hole defined therein, whereby an adjusting rod can be inserted in said through hole of said adjusting knob and said hub of said first adjusting gear to be threadedly engaged with said nut to have said second adjusting gear frictionally engaged with said first adjusting gear, so that said second adjusting gear can be integrally rotated with said first adjusting gear, and whereby said adjusting rod can be threadedly unfastened from said nut to have said second timing gear disengaged from said first timing gear so that said second timing gear can be turned relative to said first timing gear by manual adjustment to change the position of said first recessed surface relative to said second recessed surface.

5. Apparatus as claimed in claim 4, wherein said adjusting knob is provided with a wing-like head for facilitating manual adjustment.

* * * * *